US008269613B2

(12) United States Patent
Lazar

(10) Patent No.: US 8,269,613 B2
(45) Date of Patent: Sep. 18, 2012

(54) SMART CAP FOR A MEDICINE CONTAINER TO DISPENSE A MEDICATION WHILE SELF-VERIFYING MEDICINE IDENTITY

(76) Inventor: Steven S. Lazar, New York, NY (US)

( * ) Notice: Subject to any disclaimer, the term of this patent is extended or adjusted under 35 U.S.C. 154(b) by 369 days.

(21) Appl. No.: 12/322,929

(22) Filed: Feb. 9, 2009

(65) Prior Publication Data

US 2010/0200593 A1 Aug. 12, 2010

(51) Int. Cl.
*G08B 1/00* (2006.01)

(52) U.S. Cl. ..... 340/309.16; 700/240

(58) Field of Classification Search ..... 340/309.16; 221/9, 10, 15; 700/240
See application file for complete search history.

(56) References Cited

U.S. PATENT DOCUMENTS

| | | | | |
|---|---|---|---|---|
| 4,918,604 | A | 4/1990 | Baum | |
| 6,036,017 | A | 3/2000 | Bayliss | |
| 6,386,367 | B1 | 5/2002 | Bayliss | |
| 7,028,723 | B1 * | 4/2006 | Alouani et al. | 141/83 |
| 7,028,734 | B2 * | 4/2006 | Ozel et al. | 152/209.5 |
| 7,044,664 | B2 | 5/2006 | Papetti | |
| 7,269,476 | B2 * | 9/2007 | Ratnakar | 700/236 |
| 7,339,457 | B2 * | 3/2008 | Trochesset | 340/309.7 |
| 7,705,734 | B2 * | 4/2010 | Martinelli | 340/572.8 |
| 2003/0189732 | A1 | 10/2003 | Bean | |
| 2003/0200726 | A1 * | 10/2003 | Rast | 53/443 |
| 2006/0071011 | A1 * | 4/2006 | Varvarelis et al. | 221/9 |
| 2006/0220818 | A1 * | 10/2006 | Trochesset | 340/457 |
| 2008/0027291 | A1 * | 1/2008 | Williams-Hartman | 600/300 |
| 2008/0056556 | A1 * | 3/2008 | Eller et al. | 382/142 |
| 2009/0294521 | A1 * | 12/2009 | de la Huerga | 235/375 |

* cited by examiner

*Primary Examiner* — George Bugg
*Assistant Examiner* — Edny Labbees
(74) *Attorney, Agent, or Firm* — Israel Nissenbaum; Yitzy Nissenbaum

(57) ABSTRACT

A smart cap for a container to dispense a medication and for automatically (a) self-verifying at least an obverse side and a converse side of the medication once the smart cap has been programmed for the medication so as to prevent improper dispensing of the medication, (b) indicating and verifying the number of pills in the container, (c) indicating and verifying timely compliance for taking the medication as prescribed and (d) issuing instructions and/or warnings to the consumer. The cap includes necessary circuitry and displays and is programmable from computer.

16 Claims, 2 Drawing Sheets

Figure 1:
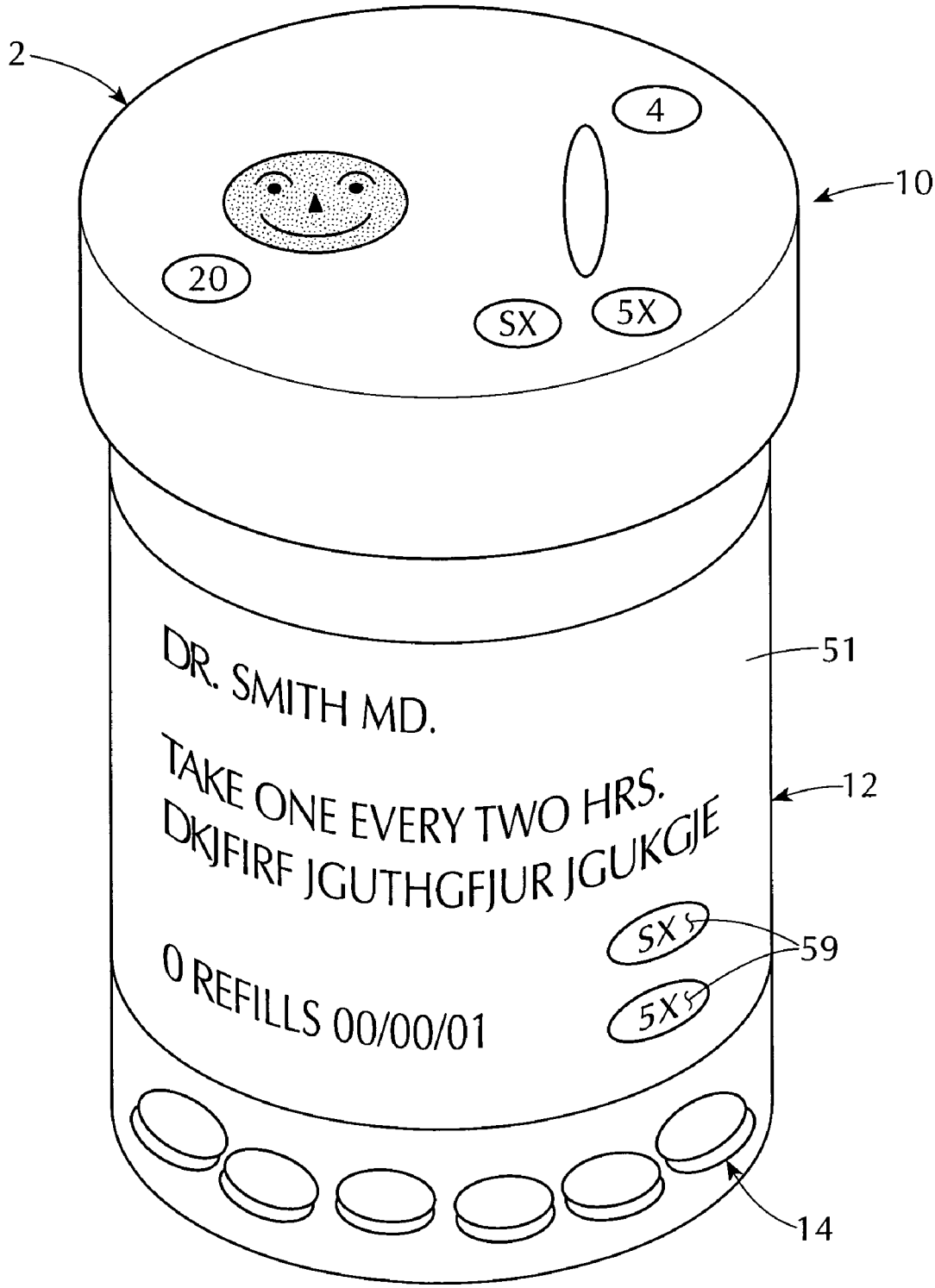

SMART CAP FOR A MEDICINE CONTAINER TO DISPENSE A MEDICATION WHILE SELF-VERIFYING MEDICINE IDENTITY

1. BACKGROUND OF THE INVENTION

A. Field of the Invention

Embodiments of the present invention, set forth herein, relate to a cap for a container, and more particularly, the embodiments of the present invention relate to a smart cap for a container used to dispense a medication and for automatically (a) self-verifying the medication once the smart cap has been programmed for the medication so as to prevent improper dispensing thereof, (b) indicating and verifying the number of pills in the container, (c) indicating and verifying timing medication as prescribed (d) communicating relevant instructions and/or cautions in a language that the patient understands, as well as (e) providing other and different features and advantages flowing and/or derivable from these.

B. Description of Prior Art[1]

Patients, especially the elderly, are prone to forget at times to take a medication or may not recall if they actually took it. This problem is aggravated with each additional medication that they are required to take.

[1]*See Improving Prescription Drug Container Labeling in the United States, A Health Literacy and Medication Safety Initiative,* A White Paper Commissioned by the American College of Physicians Foundation.

Patients often fail to realize that they are out of a medication and must go without that medication until they can get a refill.

Many patients from other countries are unable to understand English dosing instructions and/or cautions.

Errors can and do occur when physicians manuscript and/or when pharmacists read a prescription or dispense a medication to consumers. These risks have been increased by:

- increasing volume of prescriptions filled causing increased stress on physicians and on pharmacy staffs.
- increasing use of poorly trained, overworked and/or mentally challenged pharmacy technicians.
- increasing additions of FDA-approved medications, many of which look alike or sound alike.

These mix-ups, have been documented and can cause great harm and even death to consumers.

More and more, consumers are becoming confused and even anxious that the medications they are taking are the ones prescribed by their physicians, because virtually every refill seems to contain a new and unfamiliar-looking generic form of a medication. This confusion is due to the fact that insurance plans frequently change their approved formulary—generic brands that they will pay for—usually approving a least expensive manufacturer at that particular time.

Even at the wholesale level, or in hospitals or in nursing homes, it is possible that a wrong medication is packaged in a large wholesale bottle or other container having a different label. It would be virtually impossible for the pharmacist to determine this mixup. And, intentional and unintentional switching of medications among containers by others can occur without knowledge of the consumer.

Numerous innovations for medication verifying systems have been provided in the prior art, which will be described below in chronological order to show advancement in the art, and which are incorporated herein by reference. Even though these innovations may be suitable for the specific individual purposes which they address, nevertheless, they differ from the present invention in that they do not teach a smart cap for a container to dispense a medication and for automatically (a) self-verifying the medication once the smart cap has been automatically programmed for the medication so as to prevent improper dispensing of the medication, (b) indicating and verifying the number of pills in the container, (c) indicating and verifying timely compliance for taking medication as prescribed (d) communicating relevant instructions and/or cautions in a language that the patient understands. The self verifying can be accomplished using video comparison from various points of view, it can also be done using other indicia such as bar codes. Other and different teachings and advantages flow herefrom.

(1) U.S. Pat. No. 4,918,604 to Baum.

U.S. Pat. No. 4,918,604 issued to Baum on Apr. 17, 1990 in U.S. class 364 and subclass 413.01 teaches a drug labeling and prescription filing system. A multiplicity of files of data are maintained. Each file of data represents a color graphic illustration of a different prescription drug. When a prescription drug is filled, the corresponding file of data is automatically selected and used to control a color printer to print a graphic illustration of the drug of the prescription on the label applied to the container and containing the prescription data.

Baum teaches a picture of only one side of a pill on the container label, thereby only providing a visual check of one side of the pill. Baum fails if the patient has poor vision or is not competent enough to check all the medications they are taking.

(2) U.S. Pat. No. 6,036,017 to Bayliss, IV.

U.S. Pat. No. 6,036,017 issued to Bayliss, IV on Mar. 14, 2000 in U.S. class 206 and subclass 534 teaches a container for holding prescription pills or other medication, which includes a cylindrical receptacle, a detachable cap, and a label. A pill holder is positioned beneath the cap, which includes a magnifying lens through which the interior of the pill holder can be viewed. The label includes the name of the prescribed medicine and a picture of a pill. When the prescription is filled, one pill is placed in the pill holder. The pill and the pill picture can then be compared to determine if the correct medicine has been provided. The label is prepared by: providing a processor having a keyboard, a database including data relating to images of a plurality of prescription medicine pills, a label printer, and an unprinted label; entering the name of the prescription medicine into the processor; selecting an image of a pill in the database corresponding to the name; and printing the name and the selected image onto the label.

Bayliss, IV teaches providing a picture of only one side of the pill on the container label, thereby only providing a visual check of one side of the pill. Bayliss fails if the patient has poor vision or is not competent enough to check all the medications they are taking.

(3) U.S. Pat. No. 6,386,367 to Bayliss, IV.

U.S. Pat. No. 6,386,367 issued to Bayliss, IV on May 14, 2002 in U.S. class 206 and subclass 534 teaches a container for holding prescription pills or other medication, which includes a cylindrical receptacle, a detachable cap, and a label. A pill holder is positioned beneath the cap, which includes a magnifying lens through which the interior of the pill holder can be viewed. The label includes the name of the prescribed medicine and a picture of a pill. When the prescription is filled, one pill is placed in the pill holder. The pill and the pill picture can then be compared to determine if the correct medicine has been provided. The label is prepared by: providing a processor having a keyboard, a database including data relating to images of a plurality of prescription medicine pills, a label printer, and a label; entering the name of the prescription medicine into the processor; selecting an image of a pill in the database using the name entered; and printing the name and the selected image onto the label.

Bayliss, IV teaches a picture of only one side of the pill on the container label, thereby only providing a visual check of one side of the pill. Bayliss, IV fails if the patient has poor vision or is not competent enough to check all the medications they are taking.

(4) United States Patent Application Publication Number 2003/0189732 to Bean.

United States Patent Application Publication Number 2003/0189732 published to Bean on Oct. 9, 2003 in U.S. class 358 and subclass 302 teaches a prescription label having at least an image of a client who is intended to consume a prescribed drug and a prescription information region identifying at least the prescribed drug.

Bean fails by not providing patients with the ability to identify their medications.

(5) U.S. Pat. No. 7,044,664 to Papetti.

U.S. Pat. No. 7,044,664 issued to Papetti on May 16, 2006 in U.S. class 400 and subclass 124.01 teaches a prescription drug printing machine used by a physician in connection with prescribing one or more prescription drugs to a patient. The printing machine has a memory unit containing a database of information on all known available prescription drugs, including a colored pictorial representation of each of the available drugs. Each of the colored pictorial representations is a substantially similar replica of the drug it depicts. Preferably, the colored pictorial representation is an exact replica of the actual drug, and containing the drug's exact color, shape, and size. The printing device includes first and second printing apparatuses for printing a prescription drug form and a patient receipt, respectively. Both of the prescription drug form and the patient receipt include the name of the drug, a colored pictorial representation, and other information. The prescribing physician inspects each of these documents for accuracy before handing them both over to the patient. Patients remit their prescription drug form to a pharmacist and retain the patient receipt for comparison with drugs that are prepared for them by the pharmacist. The printing machine has storage apparatus for storing information concerning the prescription drug form in the memory unit of the printer in order to keep accurate patient records. The printing device optionally includes translating apparatus for translating the prescription drug information into a foreign language.

Papetti fails by providing an unnecessarily complex machine that does not permit the patients to identify their medications. The patients do not access the memory unit of the prescription drug printing machine of the physician. Further the pharmacist is not obligated to dispense a specific generic medication that the physician has prescribed.

(6) United States Patent Application Publication Number 2008/0056556 to Eller et al.

United States Patent Application Publication Number 2008/0056556 published to Eller et al. on Mar. 6, 2008 in U.S. class 382 and subclass 142 teaches a prescription imaging system for capturing, storing, and displaying images of prescription bottles during the prescription fulfillment process to monitor the quality of the fulfillment process. The system includes one or more pill cameras for capturing images of pills dispensed into one or more prescription bottles, and one or more label cameras for capturing images of the bottle labels. The images are stored on a storage device in a database record. The images can be used to verify that the pills in each bottle correspond with the associated prescription.

Eller et al. fail by not permitting patients to identify their medications.

It is apparent that numerous innovations for medication verifying systems have been provided in the prior art, some of which are being used. Furthermore, even though these innovations may be suitable for the specific individual purposes which they address, nevertheless, they would not be suitable for the purposes of the embodiments of the present invention as heretofore and hereafter described, namely, a smart cap for a container to dispense a medication and for automatically (a) self-verifying at least two (2) sides of the medication once the smart cap has been programmed for visually identifying the medication so as to prevent improper dispensing thereof, (b) indicating and verifying the number of pills in the container, (c) indicating and verifying timely, (for example daily/weekly/monthly) compliance for taking of the medication as prescribed, (d) communicating instructions and/or cautions to patients in a language(s) or vernacular(s) understandable to the patients, and/or (e) verifying some or all of the foregoing by means of bar codes or other identifiers.

2. SUMMARY OF THE INVENTION

Thus, an object of the embodiments of the present invention is to provide a smart cap for a container to dispense a medication and for automatically (a) self-verifying the medication once the smart cap has been automatically programmed for the medication so as to prevent improper dispensing thereof, (b) indicating and verifying the number of pills in the container, and (c) indicating and verifying timely compliance for medication as prescribed, (d) communicating instructions and/or cautions to patients (e) accommodates use of bar codes and/or other indicia to participate in or verify or carry forward the teaching of this invention; avoid the disadvantages of the prior art.

Briefly stated, another object of the embodiments of the present invention is to provide a smart cap for a container to dispense a medication and for automatically self-verifying the medication once the smart cap has been automatically programmed for the medication to prevent improper dispensing of the medication. The cap includes a first circuitry, a second circuitry, a third circuitry, and a first display. The first circuitry is disposed within the smart cap. The second circuitry automatically programs the first circuitry for the medication. The third circuitry is accessible within the smart cap, is in electrical communication with the first circuitry, and automatically scans the obverse and reverse sides of the medication, and (if necessary) other views of the medication, to provide a medication signal. The medication signal is sent from the third circuitry to the first circuitry to automatically self-verify the medication once the first circuitry has been programmed automatically by the second circuitry for the medication to provide a verification signal. The first display is visible on the smart cap, is in electrical communication with the first circuitry, and receives the verification signal from the first circuitry to prevent the improper dispensing of the medication.

Another object of the embodiments is to generate a depiction of at least an obverse side and a converse side of the medication as part of the label generated from a label printer. Thusly a consumer can remove one of the units of the medications from its container and compare the unit visually with at least the obverse side and converse side thereof as depicted on the label.

Another object of the embodiments is to enable a pharmacist to self-verify a medication once the smart cap has been programmed for the medication so as to check inter alia the programming. Self verifying of the medication, most particularly its appearance, is available to the pharmacist at the time of placing the medication into the container. The self verifying of the medication also is preformable by the consumer when the medication is being withdrawn by the consumer from the container.

Another object of the embodiment is to enable scanning of other features of the medication besides obverse and converse sides thereof. Side views, end vies perspective views and cross-sectional views and profiles can easily be seen according to well-known technology.

Another object of the embodiment is to facilitate use of bar codes on medications to facilitate identifications. Where medication surfaces are not suitable for bar coding, those surfaces could be covered by a suitable substance that is receptive to printing and retention of a bar code.

Another object of the embodiment is to have the label printer of the pharmacist also be provided with an optically based receptacle similar to that of the smart cap for viewing at least an obverse side and a converse side of a medication (usually a questionable or unknown one). The label printer can be provided with a data base of the physical descriptions of virtually all medications, with the data base being updated constantly. In a pharmacy, hospital, nursing home or the like, where hundreds of medications are being dispensed on a daily basis, and with many new ones (especially generic) being introduced frequently, the optically based receptacle for viewing a medication would save time, effort and waste in identifying a questionable or unknown medication by placing that medication into the optically based receptacle and displaying (for example on a liquid crystal diode) or otherwise, and/or issue a printout of the medication's name, manufacturer, country of origin, expiration date, cautions, instructions, etc.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows:

FIG. 1 is a diagrammatic perspective view of the smart cap of an embodiment of the present invention for a container to dispense a medication and for automatically (a) self-verifying the medication once the smart cap has been automatically programmed for the medication so as to prevent improper dispensing of the medication, (b) indicating and verifying the number of pills in the container, (c) indicating and verifying timely (daily/weekly/monthly) compliance for medication as prescribed; and (d) communicating instructions and/or cautions to patients.

Figure 2:
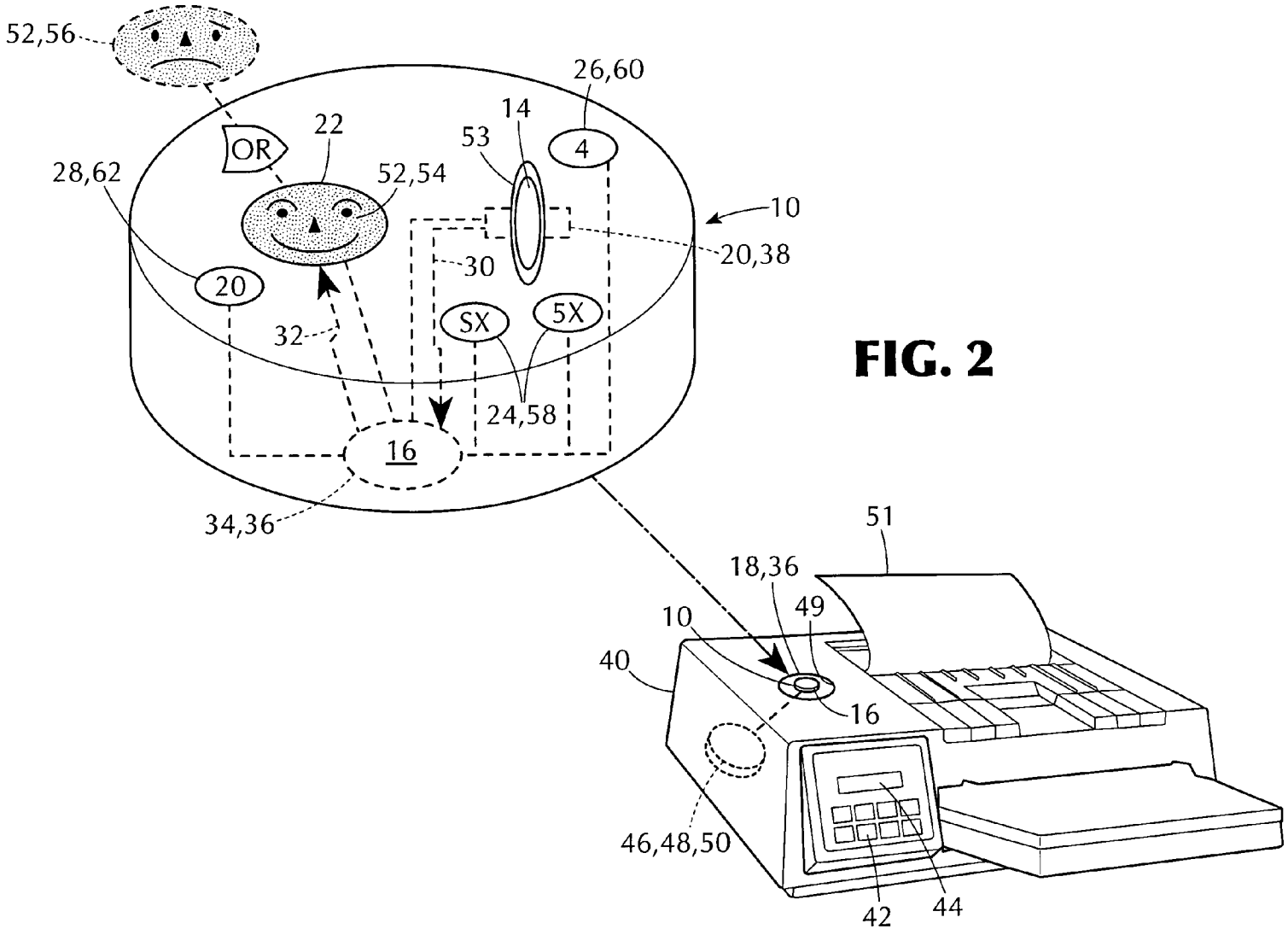

FIG. 2 is an exaggerated diagrammatic perspective view of the smart cap of an embodiment of the present invention identified by ARROW 2 in FIG. 1.

4. LIST OF REFERENCE NUMERALS UTILIZED IN THE DRAWING

| | |
|---|---|
| **A. General.** | |
| 10 | smart cap of embodiments of present invention for container 12 containing medication 14 and for automatically self-verifying medication 14 once smart cap 10 has been automatically programmed for medication 14 so as to prevent improper dispensing of medication 14 |

-continued

| | |
|---|---|
| 12 | container |
| 14 | medication |
| **B. Configuration of smart cap 10.** | |
| 16 | first circuitry |
| 18 | second circuitry |
| 20 | third circuitry |
| 22 | first display |
| 24 | second display |
| 26 | third display |
| 28 | fourth display |
| 30 | medication signal |
| 32 | verification signal |
| 34 | sub-miniature chip of first circuitry 16 |
| 36 | sub-miniature memory of first circuitry 16 |
| 38 | sub-miniature scanner of third circuitry 20 |
| 40 | label printer |
| 42 | keypad of label printer 40 |
| 44 | printer display of label printer 40 |
| 46 | fourth circuitry of label printer 40 |
| 48 | sub-miniature chip of fourth circuitry 46 of label printer 40 |
| 49 | printer receptacle in label printer 40 |
| 50 | sub-miniature memory of fourth circuitry 46 of label printer 40 |
| 51 | label of label printer 40 |
| 52 | face of first display 22 of smart cap 10 |
| 53 | cap receptacle of smart cap 10 |
| 54 | smiling face of face 52 of first display 22 of smart cap 10 |
| 56 | frowning face of face 52 of first display 22 of smart cap 10 |
| 58 | pair of medication sides of second display 24 of smart cap 10 |
| 59 | picture of obverse and reverse sides of medication 14 on label 51 of label printer 40 |
| 60 | first digital counter of third display 26 of smart cap 10 |
| 62 | second digital counter of fourth display 28 of smart cap 10 |

5. DETAILED DESCRIPTION OF THE PREFERRED EMBODIMENT

A. General.

Referring now to the figures, in which like numerals indicate like parts, and particularly to FIG. 1, which is a diagrammatic perspective view of the smart cap of an embodiment of the present invention for a container containing a medication and for automatically self-verifying the medication once the smart cap has been automatically programmed for the medication so as to prevent improper dispensing of the medication, the smart cap of the embodiments of the present invention is shown generally at 10 for a container 12 containing a medication 14 and for automatically (a) self-verifying the medication 14 once the smart cap 10 has been automatically programmed for the medication 14 so as to prevent improper dispensing of the medication 14, (b) indicating and verifying the number of pills in the container, and (c) indicating and verifying daily/weekly/monthly compliance for medication as prescribed.

B. Configuration of the Smart Cap 10.

The configuration of the smart cap 10 can best be seen in FIG. 2, which is an exaggerated diagrammatic perspective view of the smart cap of an embodiment of the present invention identified by ARROW 2 in FIG. 1, and as such, will be discussed with reference thereto.

The smart cap 10 comprises a first circuitry 16, a second circuitry 18, a third circuitry 20, a first display 22, a second display 24, a third display 26, and a fourth display 28. The first circuitry 16 is disposed within the smart cap 10. The second circuitry 18 automatically programs the first circuitry 16 for the medication 14. The third circuitry 20 is accessible within the smart cap 10, is in electrical communication with the first circuitry 16, and is for automatically scanning the obverse and reverse sides of the medication 14 so as to provide a medication signal 30. The medication signal 30 is sent from the third circuitry 20 to the first circuitry 16 for automatically self-verifying the medication 14 once the first circuitry 16 has been automatically programmed by the second circuitry 18 for the medication 14 so as to provide a verification signal 32. The first display 22 is visible on the smart cap 10, is in electrical communication with the first circuitry 16, and receives the verification signal 32 from the first circuitry 16 so as to prevent the improper dispensing of the medication 14. The second display 24 is visible on the smart cap 10, is in electrical communication with the first circuitry 16, and displays the obverse and reverse sides of the medication 14 inputted from the third circuitry 20 so as to prevent the improper dispensing of the medication 14. The third display 26 is visible on the smart cap 10, is in electrical communication with the first circuitry 16, and displays the frequency for taking the medication 14 once the first circuitry 16 has been automatically programmed by the second circuitry 18 for the medication 14. Audio means, well known in this art, can here issue instructions and/or cautions to the patient. The fourth display 28 is visible on the smart cap 10, is in electrical communication with the first circuitry 16, and displays the quantity of medication 14 in the container 12 starting with the prescribed quantity once the first circuitry 16 has been automatically programmed by the second circuitry 18 for the medication 14.

The first circuitry 16 comprises a sub-miniature chip 34 and a sub-miniature memory 36. The sub-miniature chip 34 of the first circuitry 16 is automatically programmed by the second circuitry 18 for the medication 14 and automatically self-verifies the medication 14 once the first circuitry 16 has been automatically programmed by the second circuitry 18 for the medication 14.

The second circuitry 18 comprises a sub-miniature programmer 36. The sub-miniature programmer 36 of the second circuitry 18 automatically programs the first circuitry 16 for the medication 14.

The third circuitry 20 comprises a sub-miniature scanner 38. The sub-miniature scanner 38 of the third circuitry 20 is for automatically scanning the obverse and reverse sides of the medication 14. A sample sub-miniature scanner 38 of the third circuitry 20 is the SC-5 type scanner that is manufactured by ELECTRO-OPTICAL PRODUCTS CORPORATION located at 88-65 76$^{th}$ Avenue, Glendale, N.Y. 11385, USA. See http://www.eopc.com/sc5.html.

The second circuitry 18 is disposed in a label printer 40. The label printer 40 comprises a keypad 42 and a printer display 44. The keypad 42 of the label printer 40 is for entering the medication 14, manufacturer/distributer of the medication 14, and patient information, and the printer display 44 of the label printer 36 is for displaying the medication 14, the manufacturer/distributer of the medication 14, and the patient information entered by the keypad 42 of the label printer 40.

The label printer 40 further comprises a fourth circuitry 46. The fourth circuitry 46 of the label printer 40 is in electrical communication with the second circuitry 18 and comprises a sub-miniature chip 48 and a sub-miniature memory 50 with a database of the medications 14 and the manufacturer/distributer of the medications 14 therein, allowing the keypad 42 of the label printer 40 to be used to enter the medication 14 and the consumer information to print on a label 51, while the second circuitry 18 simultaneously programs the first circuitry 16 with the medication 14, the manufacturer/distributer of the medication 14, the timely (daily/weekly/monthly) numerical frequency of the medication 14 prescribed, and the quantity of the medication 14 prescribed entered by the keypad 42 of the label printer 40 when the smart cap 10 is programmed by the second circuitry 18 by the second circuitry 18.

The label printer 40 further comprises a printer receptacle 48. The printer receptacle 48 in the label printer 40 has the second circuitry 18 thereat and holds the smart cap 10 while the second circuitry 18 programs the first circuitry 16.

The smart cap 10 further comprises a cap receptacle 53. The cap receptacle 53 of the smart cap 10 has the third circuitry 20 thereat and is a slot for holding the medication 14 while the third circuitry 20 scans the obverse and reverse sides of the medication 14.

The first display 22 of the smart cap 10 comprises a face 52. The face 52 of the first display 22 of the smart cap 10 receives the verification signal 32, and in response thereto, if the verification signal 32 is positive, then the face 52 of the first display 22 of the smart cap 10 assumes a smiling face 54, but if the verification signal 32 is negative, then the face 52 of the first display 22 of the smart cap 10 assumes a frowning face 56 so as to prevent the improper dispensing of the medication 14.

The smiling face 54 of the face 52 of the first display 22 of the smart cap 10 is illuminated green, while the frowning face 56 of the face 52 of the first display 22 of the smart cap 10 is illuminated red. Many other known positive/negative indicia could be substituted for the smiling/frowning faces.

The second display 24 of the smart cap 10 comprises a pair of medication sides 58. The pair of medication sides 58 of the second display 24 of the smart cap 10 depict the obverse and reverse sides of the medication 14 scanned by the third circuitry 20, which is then manually compared to a picture 59 of the obverse and reverse sides of the medication 14 on the label 51 (FIG. 1) entered by keypad 42 of the label printer 40 so as to be sure that the medication 14 being scanned by the third circuitry 20 is the prescribed medication 14.

The third display 26 of the smart cap 10 comprises a first digital counter 60. The first digital counter 60 of the third display 26 of the smart cap 10 depicts the numerical timely (daily/weekly/monthly) frequency of the medication 14 entered into the first circuitry 16 by the second circuitry 18 via the keypad 42 of the label printer 40 via the keypad 42 of the label printer 40 when the smart cap 10 is programmed by the second circuitry 18. It decreases by one each time the medication is placed in the cap receptacle so as to prevent improper dosage frequency of the medication 14.

The fourth display 28 of the smart cap 10 comprises a second digital counter 62. The second digital counter 62 of the fourth display 28 of the smart cap 10 depicts the quantity of the medication 14 entered into the first circuitry 16 by the second circuitry 18 via the keypad 42 of the label printer 40 via the keypad 42 of the label printer 40 when the smart cap 10 is programmed by the second circuitry 18, and decreases by one each time the medication 14 is placed in the cap receptacle and is scanned by the third circuitry 20 so as to alert when the medication 14 in the container 12 is running low.

C. Tabulations.

| | FUNCTION |
|---|---|
| CIRCUITRY | |
| First Circuitry(16) | Main Processor |
| Second Circuitry (18) | Automatically programs the first circuitry (16) |
| Third Circuitry(20) | Automatically scans the obverse and reverse sides of the medication (14) |

-continued

| | FUNCTION |
|---|---|
| Fourth Circuitry (46) | Database of the medications (14) and the manufacturer/ distributer of the medications (14) |
| DISPLAY | |
| First Display (22) | Depicts either a smiling green face (54) or a frowning red face (56) |
| Second Display (24) | Depicts the obverse and reverse sides of the medication (14) |
| Third Display (26) | Depicts the numerical daily/weekly/monthly frequency of the medication (14) |
| Fourth Display (28) | Depicts the quantity of the medication (14) remaining in the container |

D. Impressions.

It will be understood that each of the elements described above or two or more together may also find a useful application in other types of constructions differing from the types described above.

While the embodiments of the present invention have been illustrated and described as embodied in a smart cap for a container to dispense a medication and for automatically (a) self-verifying the medication once the smart cap has been automatically programmed for the medication so as to prevent improper dispensing of the medication, (b) indicating and verifying the number of pills in the container, (c) indicating and verifying timely (daily/weekly/monthly) compliance for medication as prescribed and (d) communicating instructing instructions and/or cautions to patients in a language the patient understands. However, the invention is not limited to the details shown, since it will be understood that various omissions, modifications, substitutions, and changes in the forms and details of the embodiments of the present invention illustrated and their operation can be made by those skilled in the art without departing from the spirit of the embodiments of the present invention. For example, use of a container could be extrapolated to compartmental pill organizers, boxes, bags and other containers for dispensing such medications. The basic teaching herein could be adapted to liquid delivery systems to patients, such as drip stands and more complicated equipment. Other known audio and/or video components could be introduced hereto. And various warning apparatuses such as lights, annunciators, bells or the like could be included. Both of the sides of the medication pill should appear on a label on the container.

A smart cap according to this invention could easily be reused, being reprogrammed at a pharmacy. Patients could have his or hers own smart caps. Recirculation of the smart caps could be encouraged by refunds of deposits thereon. The invention touches many industrial, social and insurance facets in a very positive ways.

Without further analysis the foregoing will so fully reveal the gist of the embodiments of the present invention that others can by applying current knowledge readily adapt them for various kindred applications without omitting features that from the standpoint of prior art fairly constitute characteristics of the generic or specific aspects of the embodiments of the present invention.

The invention claimed is:

1. A smart cap for a container dispensing a medication and configured for automatically self-verifying the identity of the medication once said smart cap has been automatically programmed for the medication so as to prevent improper dispensing of the medication, the smart cap comprising:

a) a first circuitry configured to be programmed with the identity of a medication which is properly dispensed;

b) a second circuitry configured to automatically program the first circuitry with said identity of the medication;

c) a third circuitry configured to physically scan a medication being dispensed for use by a patient; and d) a first display;

wherein said first circuitry is disposed within said smart cap;

wherein said third circuitry is accessible within said smart cap for physical scanning of the medication being dispensed;

wherein said third circuitry is in electrical communication with said first circuitry;

wherein said third circuitry is configured for automatically scanning at least an obverse side and a reverse side of the medication to thereby identify the medication being dispensed and to provide a medication identification signal;

wherein said medication identification signal is sent from said third circuitry to said first circuitry for automatically self-verifying the identity of the medication being dispensed with the programmed medication identity once said first circuitry has been automatically programmed by said second circuitry for the medication so as to provide a verification signal;

wherein said first display is visible on said smart cap;

wherein said first display is in electrical communication with said first circuitry; and wherein said first display receives said verification signal from said first circuitry so as to prevent the improper use of a medication with a mismatch between the programmed medication and the scanned medication.

2. The cap of claim 1, further comprising a second display;

wherein said second display is visible on said smart cap;

wherein said second display is in electrical communication with said first circuitry; and wherein said second display displays the at least an obverse side and a reverse side of the medication inputted from said third circuitry so as to prevent the improper dispensing of the medication.

3. The cap of claim 2, further comprising a third display;

wherein said third display is visible on said smart cap;

wherein said third display is in electrical communication with said first circuitry; and wherein said third display displays frequency for taking the medication once said first circuitry has been automatically programmed by said second circuitry for the medication and recalibrates every time a pill is placed in the chamber.

4. The cap of claim 3, further comprising a fourth display;

wherein said fourth display is visible on said smart cap;

wherein said fourth display is in electrical communication with said first circuitry; and wherein said fourth display displays quantity of medication in the container starting with a prescribed quantity once said first circuitry has been automatically programmed by said second circuitry for the medication and recalibrates every time a pill is placed in the chamber.

5. The cap of claim 1, wherein said first circuitry comprises:

a) a sub-miniature chip; and b) a sub-miniature memory; wherein said sub-miniature chip of said first circuitry is automatically programmed by said second circuitry for the medication and automatically self-verifies the medication once said first circuitry has been automatically programmed by said second circuitry for the medication.

6. The cap of claim 1, wherein said second circuitry comprises a sub-miniature programmer; and wherein said sub-miniature programmer of said second circuitry automatically programs said first circuitry for the medication.

7. The cap of claim 1, wherein said third circuitry comprises a sub-miniature scanner; and wherein said sub-miniature scanner of said third circuitry is for automatically scanning the obverse and reverse sides of the medication.

8. The cap of claim 4, wherein said second circuitry is disposed in a label printer;

wherein said label printer comprises:

a) a keypad; and b) a printer display;

wherein said keypad of said label printer is for entering the medication, frequency and timing of the medication prescribed, quantity of the medication prescribed, and patient information when said smart cap is being programmed by said second circuitry; and wherein said printer display of said label printer is for displaying the medication, manufacturer/distributer of the medication, and patient information entered by said keypad of said label printer.

9. The cap of claim 8, wherein said label printer comprises a fourth circuitry;

wherein said fourth circuitry of said label printer is in electrical communication with said second circuitry;

wherein said fourth circuitry of said label printer comprises:

a) a sub-miniature chip; and b) a sub-miniature memory with a database of the medications and the manufacturer/distributer of the medications therein, allowing said keypad of said label printer to be used to enter the medication and the consumer information to print on a label, while said second circuitry simultaneously programs said first circuitry with the medication, the manufacturer/distributer of the medication, the numerical frequency of the medication prescribed, and the quantity of the medication prescribed entered by said keypad of said label printer when said smart cap is being programmed by said second circuitry.

10. The cap of claim 8, wherein said label printer comprises a printer receptacle;

wherein said printer receptacle in said label printer has said second circuitry thereat; and wherein said printer receptacle in said label printer holds said smart cap while said second circuitry programs said first circuitry.

11. The cap of claim 1, wherein said smart cap comprises a cap receptacle;

wherein said cap receptacle of said smart cap has said third circuitry thereat; and wherein said cap receptacle of said smart cap is a slot for holding the medication while said third circuitry scans at least an obverse side and a reverse side of the medication.

12. The cap of claim 1, wherein said first display of said smart cap comprises a face; and wherein said face of said first display of said smart cap receives said verification signal, and in response thereto, if said verification signal is positive, then said face of said first display of said smart cap assumes a smiling face, but if said verification signal is negative, then said face of said first display of said smart cap assumes a frowning face so as to prevent the improper dispensing of the medication.

13. The cap of claim 12, wherein said smiling face of said face of said first display of said smart cap is illuminated green; and wherein said frowning face of said face of said first display of said smart cap is illuminated red.

14. The cap of claim 8, wherein said second display of said smart cap comprises a pair of medication sides; and wherein said pair of medication sides of said second display of said smart cap depict the obverse and reverse sides of the medication scanned by said third circuitry, which is then visually compared to a picture of the obverse and reverse sides of the medication entered on said label via said keypad of said label printer so as to be sure that the medication being scanned by said third circuitry is the prescribed medication.

15. The cap of claim 3, wherein said third display of said smart cap comprises a first digital counter; and wherein said first digital counter of said third display of said smart cap depicts frequency and timing of the medication entered into said first circuitry by said second circuitry via said keypad of said label printer when said smart cap is programmed by said second circuitry so as to prevent improper dosage frequency of the medication by decreasing by one each time the medication is either placed in the cap receptacle or is scanned by the third circuitry.

16. The cap of claim 8, wherein said fourth display of said smart cap comprises a second digital counter; and wherein said second digital counter of said fourth display of said smart cap depicts the quantity of the medication entered into said first circuitry by said second circuitry via said keypad of said label printer when said smart cap is programmed by said second circuitry, and decreases by one each time the medication is scanned by said third circuitry so as to alert when the medication in the container is running low.

* * * * *